US009289075B2

(12) United States Patent
Wu

(10) Patent No.: US 9,289,075 B2
(45) Date of Patent: Mar. 22, 2016

(54) METAL CRIB BEDSTEAD

(71) Applicant: Kuo-Chang Wu, Kaohsiung (TW)

(72) Inventor: Kuo-Chang Wu, Kaohsiung (TW)

( * ) Notice: Subject to any disclaimer, the term of this patent is extended or adjusted under 35 U.S.C. 154(b) by 0 days.

(21) Appl. No.: 14/303,328

(22) Filed: Jun. 12, 2014

(65) Prior Publication Data

US 2015/0033473 A1 Feb. 5, 2015

(30) Foreign Application Priority Data

Jul. 31, 2013 (TW) ..... 102214367 U

(51) Int. Cl.
*A47D 9/00* (2006.01)
*A47C 23/155* (2006.01)

(52) U.S. Cl.
CPC ..... *A47D 9/00* (2013.01); *A47C 23/155* (2013.01)

(58) Field of Classification Search
CPC ..... A47D 7/00–11/007; A47C 23/155
See application file for complete search history.

(56) References Cited

U.S. PATENT DOCUMENTS

| | | | | | |
|---|---|---|---|---|---|
| 3,590,403 | A * | 7/1971 | Mixon | ..... | 5/100 |
| 3,900,907 | A * | 8/1975 | Mulder | ..... | 5/100 |
| 4,924,539 | A * | 5/1990 | Benoit | ..... | 5/100 |
| 4,951,330 | A * | 8/1990 | Burnham | ..... | 5/93.1 |
| 5,361,432 | A * | 11/1994 | Shamie | ..... | 5/11 |
| 8,112,834 | B1 * | 2/2012 | Shamie et al. | ..... | 5/93.1 |
| 8,646,127 | B1 * | 2/2014 | Lytle | ..... | 5/93.1 |
| 2014/0259393 | A1 * | 9/2014 | Clute et al. | ..... | 5/98.1 |

* cited by examiner

*Primary Examiner* — David E Sosnowski
*Assistant Examiner* — Eric Kurilla
(74) *Attorney, Agent, or Firm* — Muncy, Geissler, Olds & Lowe PC

(57) ABSTRACT

A metal crib bedstead includes a pair of symmetrical widthwise frames, a pair of symmetrical longitudinal frames, a mattress support frame and four elongated anchor planks. The widthwise frames and the longitudinal frames are made of metal and coupled together by wedging and welding. The mattress support frame includes an outer frame, a mesh frame and a plurality of springs connecting the mesh frame to the outer frame to evenly hold a mattress on the mattress support frame. The elongated anchor planks connect to the widthwise frame and the mattress support frame, and four anchor struts are fastened on the outer frame respectively near the lower ends of the elongated anchor planks for the anchor planks to rest without swaying. Hence the mattress support frame with different sizes can be coupled with the widthwise frames and the longitudinal frames. Assembly can be done quickly with enhanced strength.

4 Claims, 11 Drawing Sheets

METAL CRIB BEDSTEAD

FIELD OF THE INVENTION

The present invention relates to a metal crib bedstead and particularly to a crib bedstead that is made of metal and adoptable to mattress support brackets of different sizes.

BACKGROUND OF THE INVENTION

Most conventional cribs have a bedstead made from wood. Although the wood has advantages such as the aroma of logs and great visual aesthetic appeal of traces of growth rings, greater consumption of the wood causes excessive lumbering that is subject to greater restriction as the awareness of environmental protection becomes stronger in the society these days. Thus, the wood becomes more expensive, and the crib bedstead made from wood also is more costly and has environmental protection concern.

As a result, crib bedsteads made of metal have been developed and marketed. The crib bedsteads made of metal tubes are increasingly popular in recent years. They generally are made by coupling and welding metal tubes together. However, welding the metal tubes by soldering is time consuming. Moreover, the metal tubes need to be aligned precisely to avoid inaccurate soldering, thus makes fast assembly difficult. Moreover, the general crib bedstead made of metal tubes, please referring to FIG. 1A, includes a mattress support frame A and a mesh frame A2 that are located at the bottom of a main frame of the crib bedstead coupled with each other by a plurality of springs B. Each spring B includes two hooks B1 that are formed at two ends thereof and latch in an aperture A1 of the mattress support frame A and the mesh frame A2 respectively. The two hooks B1 mostly are formed at a length greater than a diameter of the spring B. Therefore, when a mattress C is placed onto the mattress support frame A the two hooks B1 easily pierce into the mattress C (as shown in FIG. 1B). Moreover, when children jump on the mattress C, due to both the two hooks B1 are formed in a curved shape without inverse hooks, they merely contact with the aperture A1 of the mattress support frame A and the mesh frame A2 at a point respectively. As a result, the two hooks B1 easily escape from the aperture A1 and the mesh frame A2 when subject to jumping under external forces, and fail to securely latch on the inner top surface of the mattress support frame A.

SUMMARY OF THE INVENTION

The primary object of the present invention is to provide a metal crib bedstead to solve the problems of the conventional wooden crib bedsteads that lacks adequate strength and is not eco-friendly.

To achieve the foregoing object, the metal crib bedstead according to the invention includes a pair of symmetrical widthwise frames, a pair of symmetrical longitudinal frames, a mattress support frame and four elongated anchor planks. The widthwise frames and longitudinal frames are made of metal and coupled together by wedging. Each widthwise frame includes an U-shaped tube, an upper transverse tube and a lower transverse tube that are connected to two ends of the U-shaped tube by welding and opposite to each other, and a plurality of first longitudinal tubes connected with the upper transverse tube and the lower transverse tube. Each longitudinal frame includes an upper transverse frame tube and a lower transverse frame tube that are opposite to each other, and a plurality of second longitudinal tubes connected with the upper transverse frame tube and the lower transverse frame tube by welding. The mattress support frame includes an outer frame, a mesh frame and a plurality of springs connecting the outer frame to the mesh frame to evenly hold a mattress above the mattress support frame. Each elongated anchor plank has an upper end connected to the widthwise frames, and a lower end connecting to the mattress support frame. The mattress support frame further has four anchor struts respectively below the four elongated anchor planks for the four elongated anchor planks to rest, thus forms secure anchoring without swaying easily.

The metal crib bedstead of the invention improves the problems of the conventional crib bedsteads that lacks adequate strength and is not eco-friendly, and also resolve the problems of the conventional metal crib bedsteads made by soldering of metal tubes that are hard to align the metal tubes and difficult in assembly. Furthermore, solving the problems of hooks at two ends of the springs which have excessive heights to pierce into the mattress easily and tend to escape from the apertures of the mesh frame affected by external forces during jumping.

The metal crib bedstead of the invention has the widthwise frames and the longitudinal frames which are formed respectively in pairs and made of metal and can be coupled together by wedging, thus can be assembled quickly and reduce consumption of wood, and provide greater benefits to environmental protection.

In short, the metal crib bedstead according to the invention can provide many advantages, notably:

Improve structural strength and safety, and makes assembly simpler, and suit the mattress support frames of different sizes according to growth of babies.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1A:
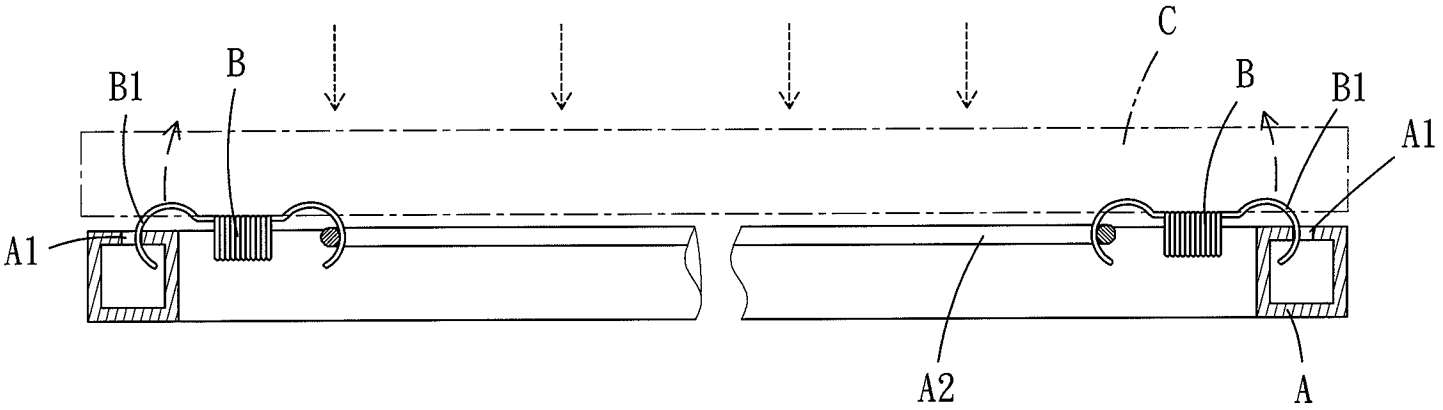
Fig. 1A PRIOR ART
FIG. 1A is a schematic side view of a conventional crib bedstead showing the springs between a mattress support frame and a mesh frame.
Figure 1B:
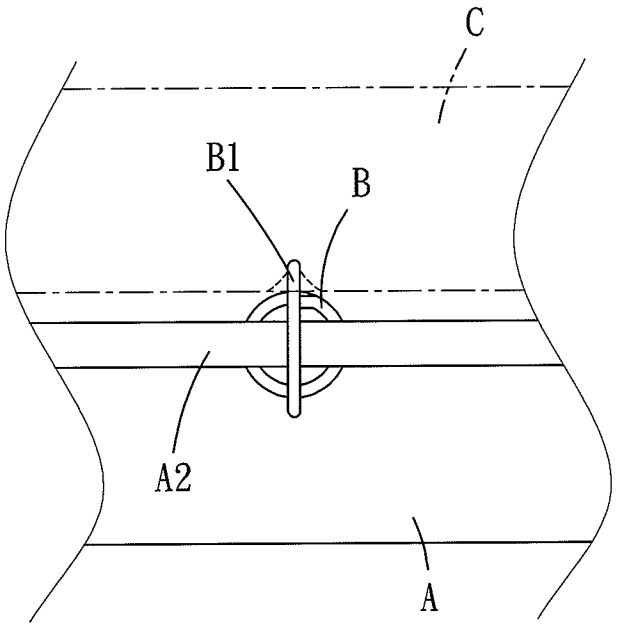
Fig. 1B PRIOR ART
FIG. 1B is a schematic view according to FIG. 1A showing the spring having excessive height piercing into the mattress.
Figure 2A:
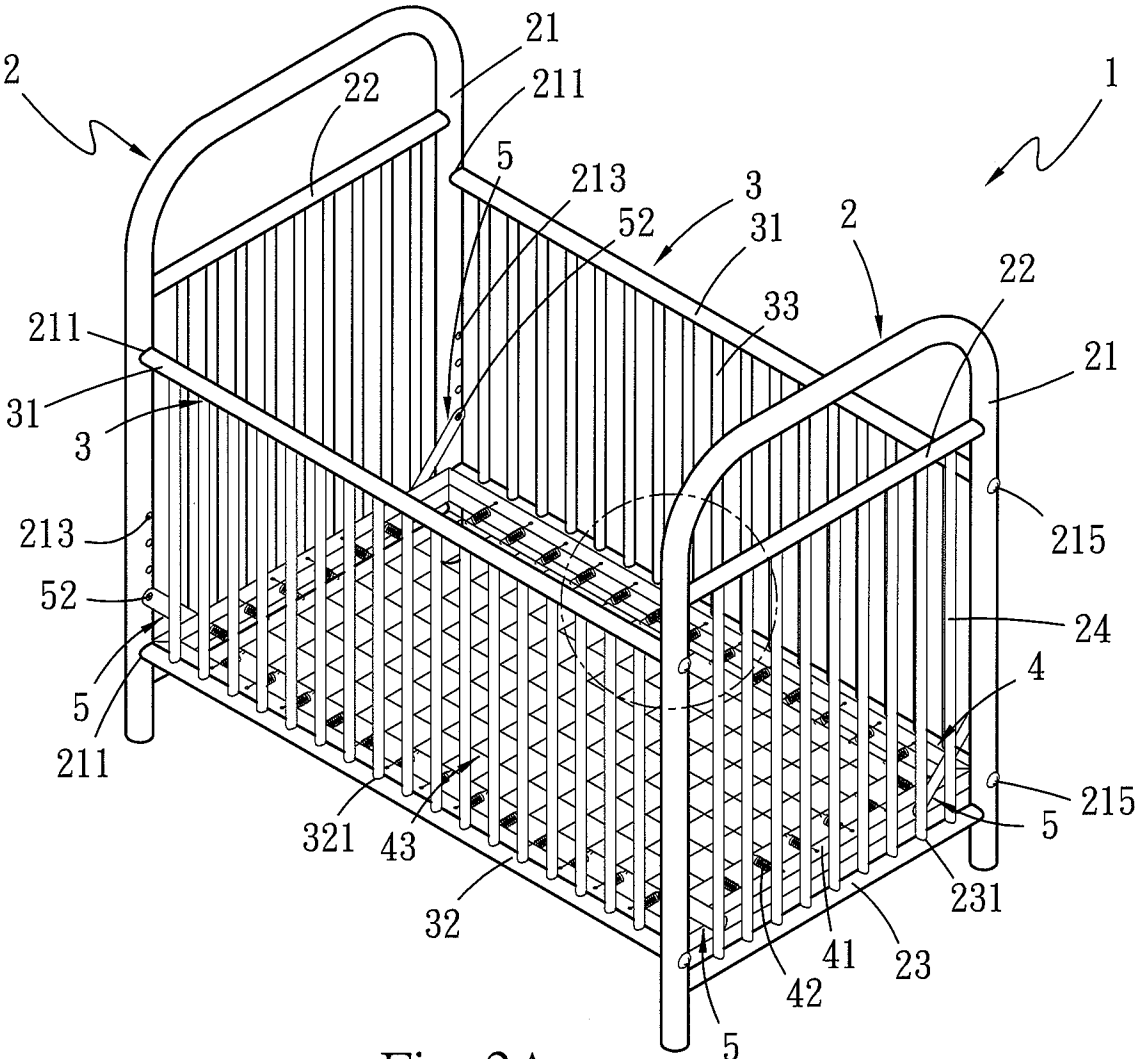
FIG. 2A is a perspective view of the metal crib bedstead of the invention.
Figure 2B:
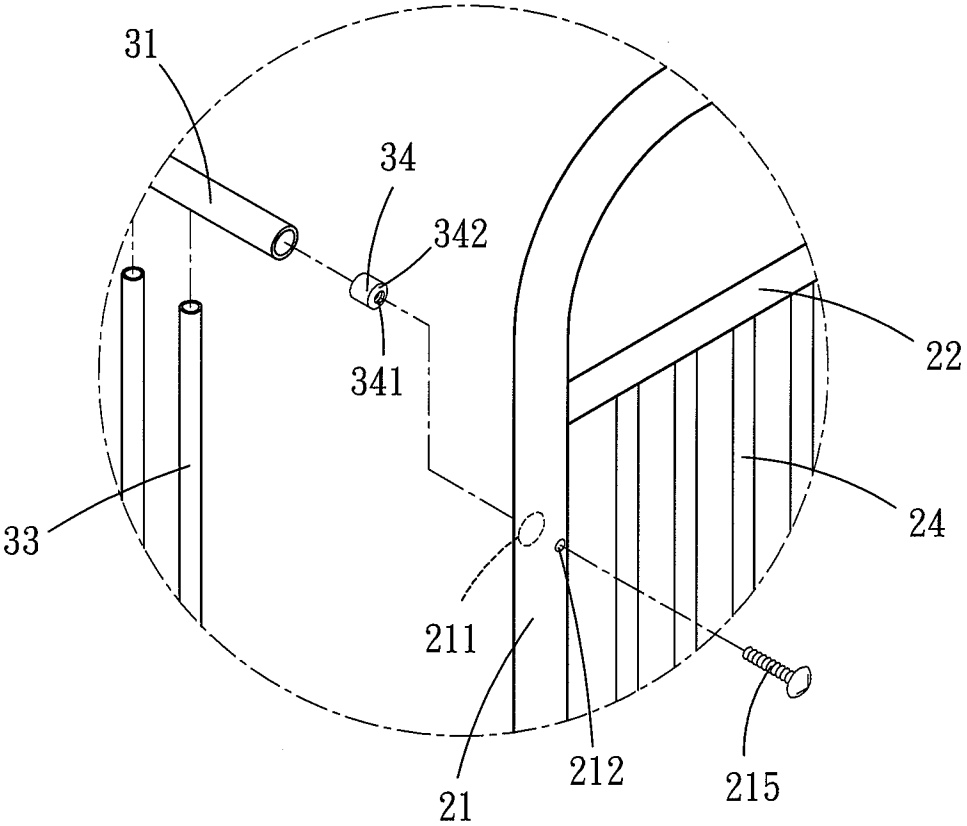
FIG. 2B is a fragmentary exploded view of the circled area in FIG. 2A showing a longitudinal frame and a widthwise frame.
Figure 3:
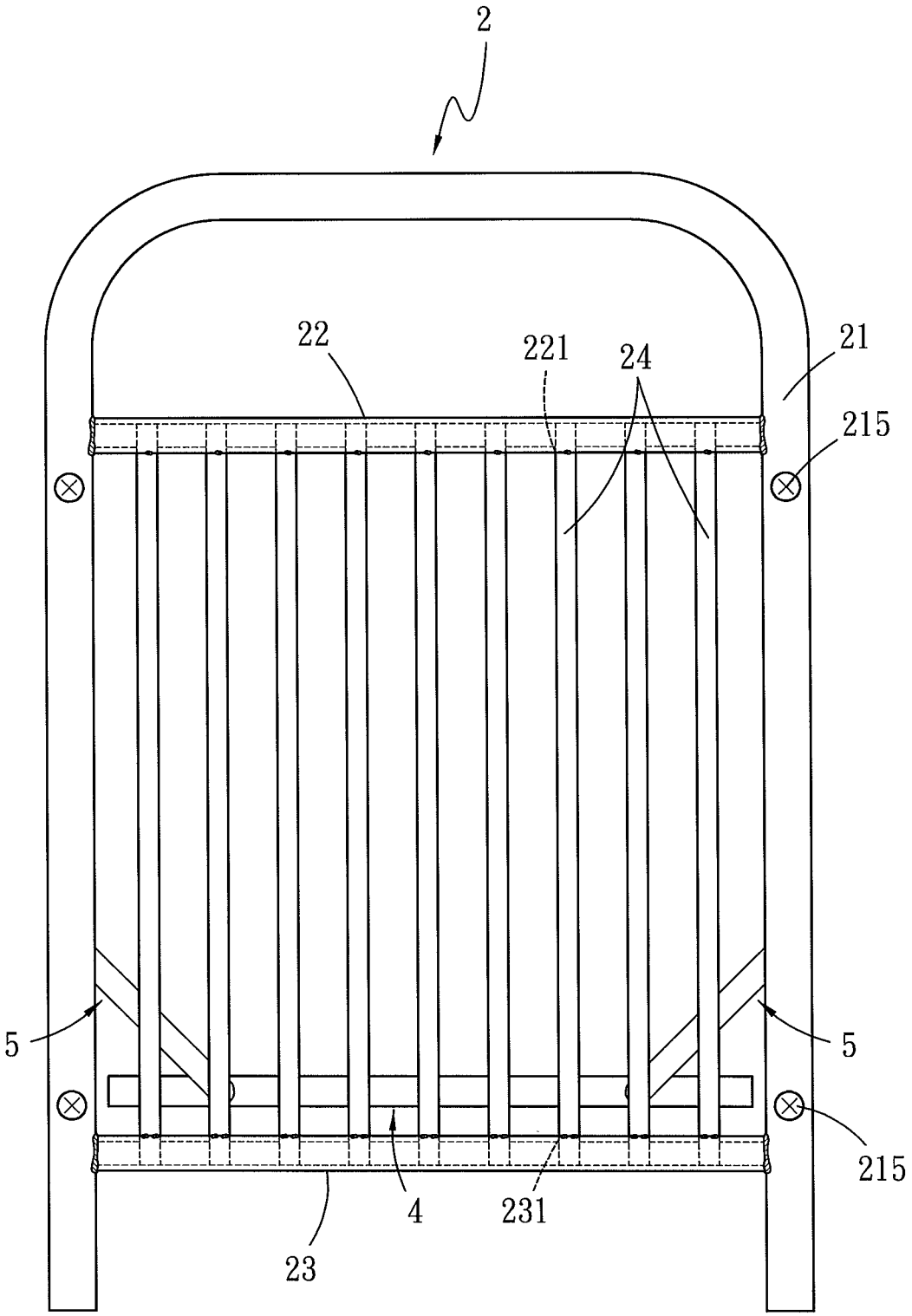
FIG. 3 is a side view of a widthwise frame of the invention.
Figure 4:
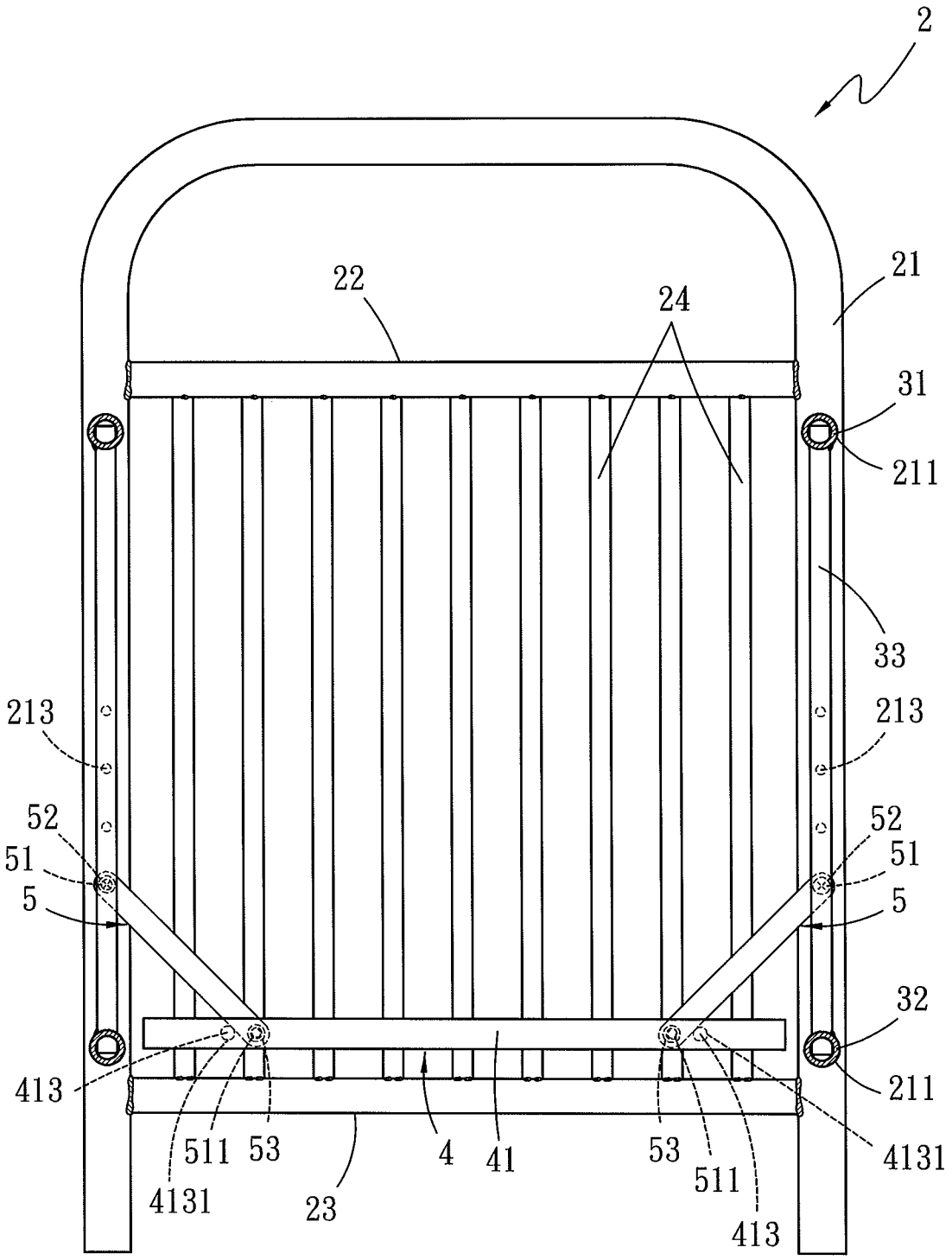
FIG. 4 is a sectional view of the widthwise frame according to FIG. 3.

Please referring to FIGS. 2A, 2B and 3 through 6, the present invention aims to provide a metal crib bedstead 1 that includes a pair of symmetrical widthwise frames 2, a pair of symmetrical longitudinal frames 3, a mattress support frame 4 and four elongated anchor planks 5.

Each widthwise frame 2 is made of metal and includes a U-shaped tube 21, an upper transverse tube 22 and a lower transverse tube 23 that are connected to two ends of the U-shaped tube 21 by welding and opposite to each other, and a plurality of first longitudinal tubes 24 connected with the upper transverse tube 22 and the lower transverse tube 23. Each of the two ends of the U-shaped tube 21 includes two wedge holes 211 formed at an inner side thereof, and two apertures 212 formed at an outer side thereof corresponding to the two wedge holes 211, and a plurality of adjustment holes 213 formed between the two wedge holes 211. In this embodiment the adjustment holes 213 are formed closed to the wedge hole 211 near the bottom to allow users to make adjustment according to the height of children and children's safety concern. The upper transverse tube 22 and the lower transverse tube 23 have respectively two ends that are welded with the two ends of the U-shaped tube 21 for anchoring. The upper transverse tube 22 and the lower transverse tube 23 respectively include a plurality of first upper wedge holes 221 and a plurality of first lower wedge holes 231 that are corresponding to each other for receiving the plurality of first longitudinal tubes 24 by wedging and allowing the plurality of the first longitudinal tubes 24 to fasten to the upper transverse tube 22 and the lower transverse tube 23 by welding for anchoring. Thus the first longitudinal tubes 24 can securely fasten to the upper transverse tube 22 and the lower transverse tube 23 and save assembly time.

Each longitudinal frame 3 is made of metal, and includes an upper transverse frame tube 31 and a lower transverse frame tube 32 that are opposite to each other, and a plurality of second longitudinal tubes 33 connected with upper transverse frame tube 31 and the lower transverse frame tube 32 by welding. The upper transverse frame tube 31 and the lower transverse frame tube 32 are wedged respectively in the wedge holes 211 of the U-shaped tube 21, and two ends thereof respectively hold a screw nut 34 with an internal screw hole 341. The screw nut 34 includes an arched surface 342 at one end thereof abutting against the inner surface of the U-shaped tube 21, and the screw hole 341 thereof corresponds to the aperture 212. The arched surface 342 is formed in a profile matched the curve of the inner surface of the U-shaped tube 21. Thus, a screw 215 can run through the aperture 212 to engage with the internal screw hole 341 of the screw nut 34 to securely fasten the upper transverse frame tube 31 and the lower transverse frame tube 32 respectively to the U-shaped tube 21, and through the arched surface 342 tightly abutting against the U-shaped tube 21 no deformation will occur. The upper transverse frame tube 31 and the lower transverse frame tube 32 also respectively include a plurality of second upper wedge holes 311 and a plurality of second lower wedge holes 321 that are opposite to each other for receiving the plurality of second longitudinal tubes 33 by wedging and allowing the the plurality of second longitudinal tubes 33 to fasten to the upper transverse frame tube 31 and the lower transverse frame tube 32 by welding for anchoring. Thereby the second longitudinal tubes 33 can securely fasten to the upper transverse frame tube 31 and the lower transverse frame tube 32 and save assembly time.

The mattress support frame 4 is located at bottoms of the pair of symmetrical widthwise frames 2 and the pair of symmetrical longitudinal frames 3. Also referring to FIGS. 7A and 7B, the mattress support frame 4 includes an outer frame 41, a plurality of springs 42 and a mesh frame 43.

The outer frame 41 includes two opposing width sides 411, four transverse anchor holes 412 respectively at the two width sides 411 and four screw hole 4131 respectively formed at an outer side of the four transverse anchor holes 412 to engage with four anchor struts 413 which can be a screw or pin in this embodiment. The outer frame 41 also includes a plurality of first latch holes 414 formed at four sides thereof.

Each spring 42 includes two flat extension portions 421 which respectively extend outwards from two sides thereof, a first hook 422 extended from one flat extension portion 421, a second hook 4221 extended from another flat extension portion 421, and two inverse hooks 423 which respectively extend from the first hook 422 and the second hook 4221 and include a horizontal surface abutting against the inner top end of the outer frame 41. The first hook 422 and the second hook 4221 are formed respectively at an length smaller than the diameter of the spring 42 so that the first hook 422 and the second hook 4221 will not exceed the height of the spring 42.

Figure 7A:
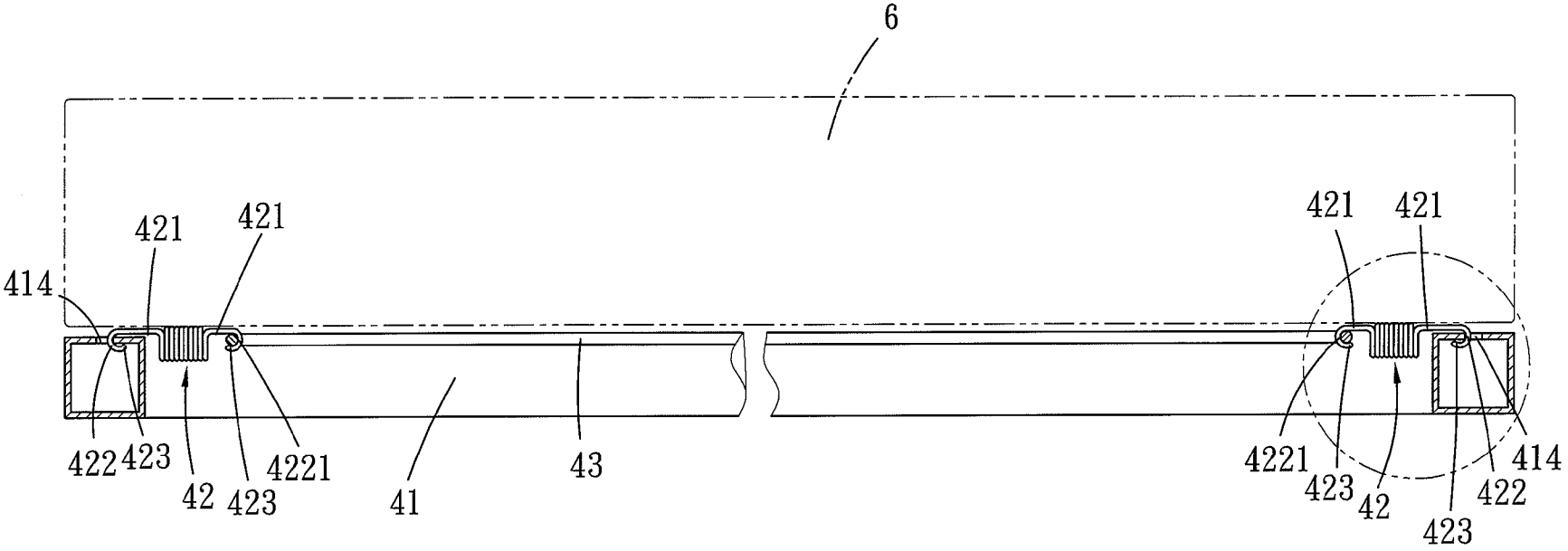
FIG. 7A is a side view of the invention showing that a mattress is placed above the mattress support frame and the mattress support frame and a mesh frame are connected by springs.
Figure 7B:
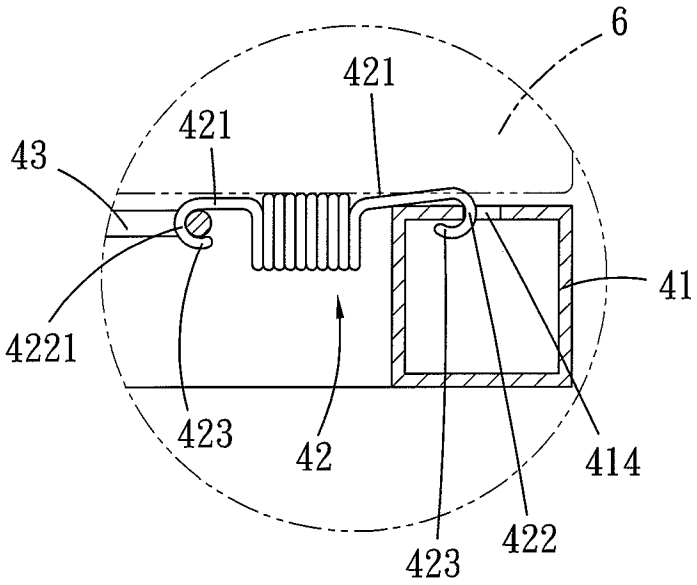
FIG. 7B is a fragmentary enlarged view according to FIG. 7A.

The mesh frame 43 includes a rim hooked by the second hooks 4221 of the springs 42 for anchoring, so that a mattress 6 can be rest above the mesh frame 43 and the springs 42 (referring to FIG. 7A). When children jump on the mattress 6, the first hook 422 latched on the first latch hole 414 of the outer frame 41 and the second hook 4221 latched on the mesh frame 43 receive compression stress. At that time, the extension portion 421 near the first hook 422 tilts upwards, and the inverse hook 423 extended from the first hook 422 latches on the inner surface of the outer frame 41 to form anchoring so that the first hook 422 does not escape from the first latch hole 414 (referring to FIGS. 7A and 7B). At the same time, the second hook 4221 also latches on the mesh frame 43 through the inverse hook 423 extended therefrom for anchoring without sliding out.

Figure 6:
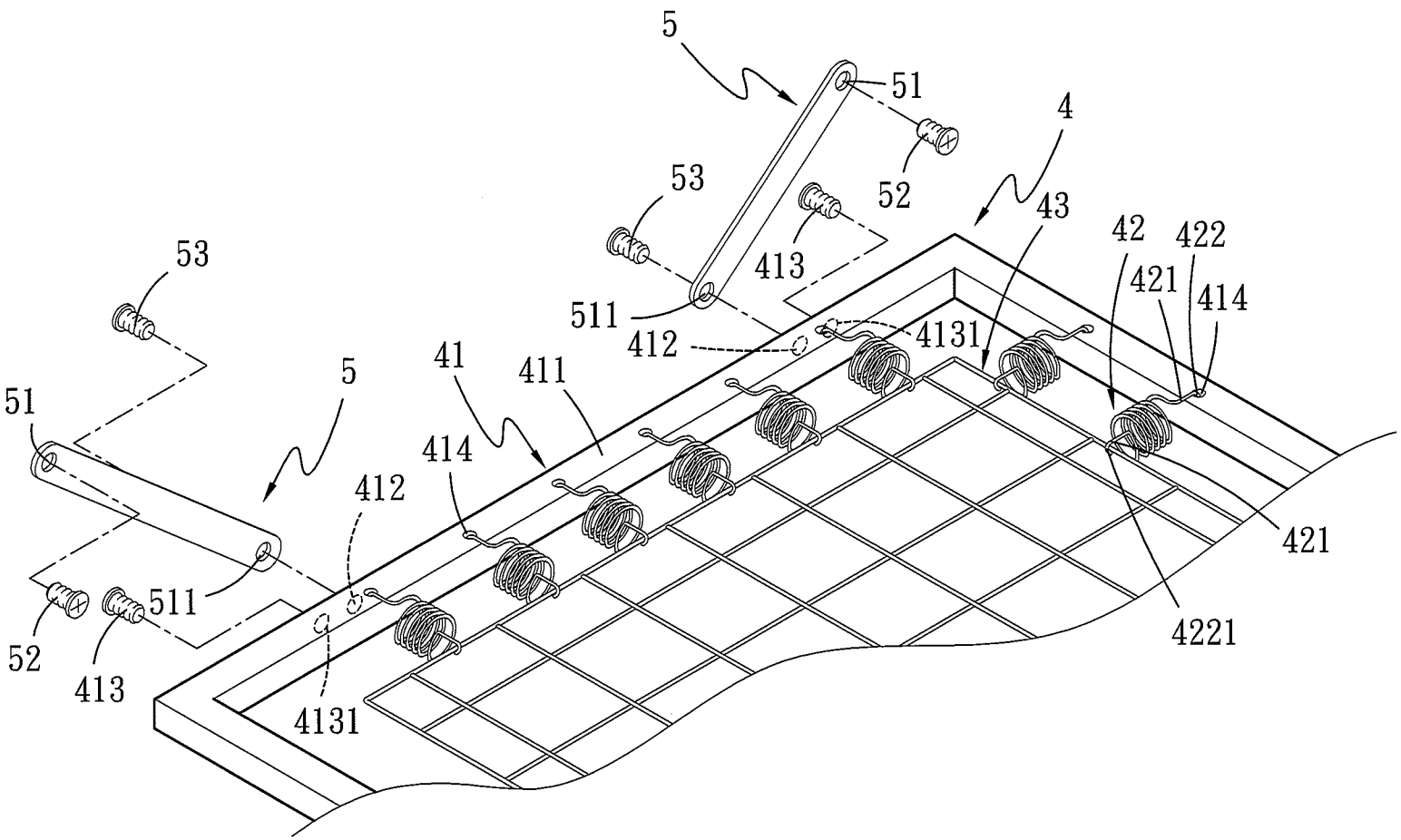
FIG. 6 is a fragmentary exploded view of an elongated anchor planks and a mattress support frame of the invention.

As shown in FIG. 6, each of the four anchor planks 5 includes a positioning hole 51 formed at an upper end thereof corresponding to the adjustment holes 213 of the U-shaped tube 21, and a fastening hole 511 at a lower end corresponding to the transverse anchor hole 412 of the outer frame 41.

Figure 5A:
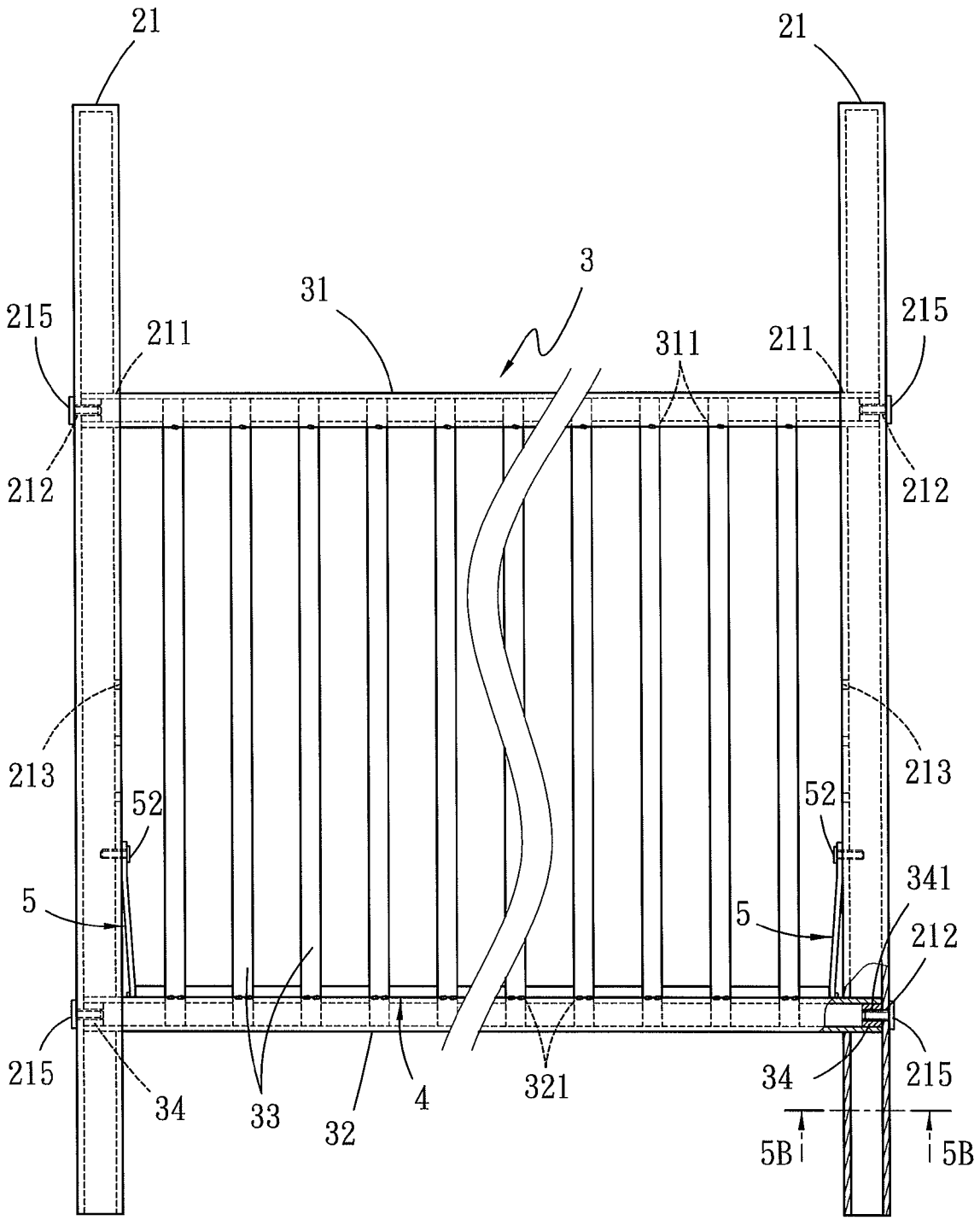
FIG. 5A is a side view with a fragmentary sectional view of the widthwise frame and the longitudinal frame in a coupling condition.
Figure 5B:
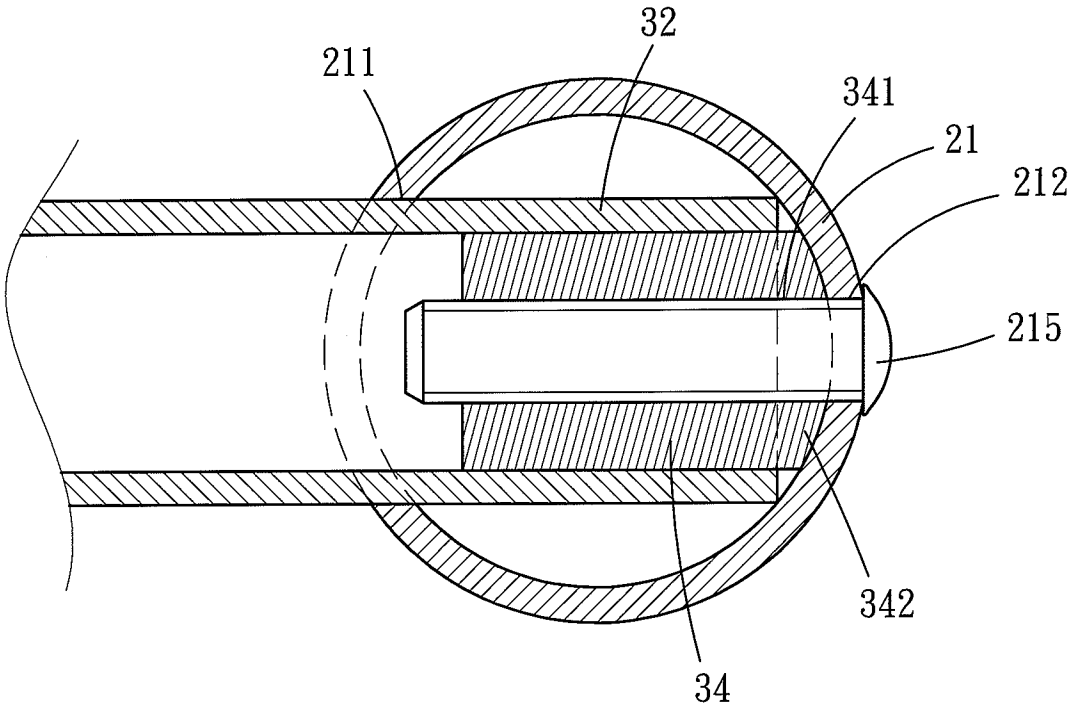
FIG. 5B is a cross section view taken on line 5B-5B in FIG. 5A.

Also referring to FIGS. 5A, 5B and 6, elevation of the mattress support frame 4 can also be adjusted as desired. By running a screw 52 through the positioning hole 51 at the upper end of the elongated anchor plank 5 to fasten to one of the adjustment holes 213 of the U-shaped tube 21, and running another screw 53 through the fastening hole 511 at the lower end of the elongated anchor plank 5 to fasten to the corresponding transverse anchor hole 412 of the outer frame 41, the mattress support frame 4 can be connected with the widthwise frame 2. Besides, by making the elongated anchor plank 5 rest on the anchor strut 413 fastened to the outer side thereof, the mattress support frame 4 can be securely positioned without swaying.

What is claimed is:

1. A metal crib bedstead, comprising:

a pair of symmetrical widthwise frames each including an U-shaped tube, an upper transverse tube and a lower transverse tube that are connected to two ends of the U-shaped tube by welding and opposite to each other, and a plurality of first longitudinal tubes connected with the upper transverse tube and the lower transverse tube, each of the two ends of the U-shaped tube including two wedge holes formed at an inner side thereof, two apertures formed at an outer side thereof corresponding to the two wedge holes, and a plurality of adjustment holes formed between the two wedge holes, the upper transverse tube and the lower transverse tube respectively including a plurality of first upper wedge holes and a plurality of first lower wedge holes for receiving the plurality of first longitudinal tubes by wedging and allowing the plurality of first longitudinal tubes to fasten to the upper transverse tube and the lower transverse tube by welding a pair of symmetrical longitudinal frames each including an upper transverse frame tube and a lower transverse frame tube that are opposite to each other, and a plurality of second longitudinal tubes connected with the upper transverse frame tube and the lower transverse frame tube by welding, the upper transverse frame tube and the lower transverse frame tube wedged respectively in the wedge holes of the U-shaped tubes through screw nuts that are respectively held in two ends of the upper transverse frame tube and the lower transverse frame tube and through screws that pass through the apertures to fasten to the screw nuts, each of the screw nuts including an arched surface at one end thereof abutting against the inner surface of the U -shaped tube and corresponding to the aperture, the upper transverse frame tube and the lower transverse frame tube also including respectively a plurality of second upper wedge holes and a plurality of second lower wedge holes for receiving the plurality of second longitudinal tubes by wedging and allowing the plurality of second longitudinal tubes to fasten to the upper transverse frame tube and the lower transverse frame tube by welding; and a mattress support frame which is located at bottoms of the pair of widthwise frames and the pair of longitudinal frames and includes an outer frame, a plurality of springs and a mesh frame, the outer frame including four transverse anchor holes respectively at two opposite width sides thereof and a plurality of first latch holes at four sides thereof facing upwards, each of the plurality of springs including two flat extension portions respectively extended outwards from two ends thereof, a first hook extended from one flat extension portion to latch in one of the first latch holes, a second hook extended from another flat extension portion to latch on a rim of the mesh frame, and two inverse hooks respectively extended from the first hook and the second hook, the first hook and the second hook being formed respectively at a length smaller than the diameter of the spring; and four elongated anchor planks each including a positioning hole at an upper end thereof corresponding to one of the adjustment holes of the U-shaped tube to receive a screw for fastening, and a fastening hole at a lower end thereof corresponding to the transverse anchor hole of the outer frame to receive another screw for fastening.

2. The metal crib bedstead of claim 1, wherein the arched surface of the screw nut matches the curve of the inner surface of the U -shaped tube.

3. The metal crib bedstead of claim 1, wherein the outer frame includes four anchor struts respectively at an outer side of the four transverse anchor holes for the four elongated anchor planks to rest.

4. The metal crib bedstead of claim 3, wherein the four anchor strut are screws fastened to screw holes respectively formed at the outer side of the four transverse anchor holes.

* * * * *